US008915809B2

(12) United States Patent
Canobbio

(10) Patent No.: US 8,915,809 B2
(45) Date of Patent: Dec. 23, 2014

(54) AMUSEMENT BALL WITH INTERNAL STRUCTURE FOR RELEASING WALL STAINING LIQUID

(71) Applicant: Dan Canobbio, Frisco, TX (US)

(72) Inventor: Dan Canobbio, Frisco, TX (US)

( * ) Notice: Subject to any disclaimer, the term of this patent is extended or adjusted under 35 U.S.C. 154(b) by 0 days.

(21) Appl. No.: 14/061,267

(22) Filed: Oct. 23, 2013

(65) Prior Publication Data

US 2014/0135156 A1 May 15, 2014

Related U.S. Application Data

(60) Provisional application No. 61/724,975, filed on Nov. 10, 2012.

(51) Int. Cl.

| | |
|---|---|
| ***A63B 43/00*** | (2006.01) |
| *A63B 39/06* | (2006.01) |
| *A63B 41/08* | (2006.01) |
| *A63B 39/00* | (2006.01) |

(52) U.S. Cl.

CPC ..... *A63B 43/008* (2013.01); *A63B 39/06* (2013.01); *A63B 41/08* (2013.01); *A63B 2039/006* (2013.01); *A63B 2208/12* (2013.01)

USPC ..... 473/594; 473/577

(58) Field of Classification Search

CPC ..... A63B 39/00; A63B 41/00; A63B 43/00; A63B 43/008

USPC ..... 473/594, 595, 604, 609, 577; 273/DIG. 20

See application file for complete search history.

(56) References Cited

U.S. PATENT DOCUMENTS

| | | | | |
|---|---|---|---|---|
| 4,088,319 | A * | 5/1978 | Clarke | 473/575 |
| 4,890,838 | A * | 1/1990 | Rudell et al. | 273/138.1 |
| 5,288,261 | A * | 2/1994 | Spector | 446/267 |
| 5,320,345 | A * | 6/1994 | Lai et al. | 473/601 |
| 5,836,827 | A * | 11/1998 | Ogawa et al. | 473/125 |
| 6,287,226 | B1 * | 9/2001 | Dilling | 473/594 |
| 6,862,995 | B2 * | 3/2005 | Kerr | 102/502 |
| 6,994,642 | B2 * | 2/2006 | Gerak et al. | 473/594 |
| 7,134,978 | B2 * | 11/2006 | Liu et al. | 473/577 |
| 7,444,938 | B2 * | 11/2008 | Tippmann | 102/498 |
| 7,478,545 | B1 * | 1/2009 | Gerak et al. | 66/170 |
| 7,481,727 | B2 * | 1/2009 | Chia | 473/577 |
| 2006/0205546 | A1 * | 9/2006 | Liu et al. | 473/594 |
| 2011/0003655 | A1 * | 1/2011 | Chernick et al. | 473/594 |
| 2012/0028742 | A1 * | 2/2012 | Van Der Linden | 473/594 |
| 2014/0135156 | A1 * | 5/2014 | Canobbio | 473/594 |

* cited by examiner

*Primary Examiner* — Steven Wong

(57) ABSTRACT

The amusement ball for a user having an inner surface membrane filled with air, a thin puncturable unit covering the inner surface membrane and an outer membrane unit covering the thin puncturable unit. The thin puncturable unit includes one or more first chambers and a thin puncturable membrane attached to the one or more first chambers. The outer membrane unit includes one or more second chambers and a non-permeable outer membrane attached to the one or more second chambers. A user applies a pressure on a specific location of the inner surface membrane through the outer membrane unit resulting in the bursting of the thin puncturable membrane and release of the liquid from one or more first chambers to one or more second chambers. The liquid then appears on the inner surface of outer permeable membrane.

4 Claims, 4 Drawing Sheets

AMUSEMENT BALL WITH INTERNAL STRUCTURE FOR RELEASING WALL STAINING LIQUID

BACKGROUND OF THE INVENTION

1. Field of the Invention

The present invention generally relates to an amusement ball, and more particularly relates to an amusement ball with an internal structure for releasing wall staining liquid.

2. Description of Related Art

Various balls are available to provide amusement to kids. These balls could be rugby balls, soccer balls, cricket balls and footballs etc. Children play with these balls for playing a particular sport. Generally, these balls are made with different colors as per the requirement of game. The colors on such balls are permanent and only fade away with the prolonged use of balls.

Now-a-days, children tend to lose interest in the outdoor games and mainly focus on computer games that engage the user with colorful graphics and mental challenge but no physical activity. Generally speaking, traditional sport products tend to not match the creativity of computer games. It is necessary for the children to play outdoor games and thus there is a need to bring changes in the sport balls to bring the interest of the children to play outdoor games. Therefore, the present invention provides an amusement ball with an internal structure for releasing wall staining liquid.

SUMMARY OF THE INVENTION

In accordance with the teachings of present invention an amusement ball with an internal structure for releasing wall staining liquid is provided.

An object of the present invention is to provide the amusement ball with an inner surface membrane filed with air or gas, a thin puncture unit positioned around the inner surface membrane includes one or more first chambers and a thin puncturable membrane attached to said one or more first chambers; and an outer membrane unit positioned around the thin puncture unit and the inner surface membrane comprising one or more second chambers and a non-permeable outer membrane attached to said one or more second chambers. The one or more first chambers are filled with liquid and the one or more second chambers are empty. The thin puncturable membrane bursts upon exertion of pressure leading to release of the liquid from one of the one or more first chambers to one of the one or more second chambers. The liquid then appears on the inner surface of the outer membrane.

Another object of the present invention is to provide either similar color liquid or different color or mixed color in each of the one of the one or more first chambers.

These and other objects, features and advantages of the invention will become more fully apparent in the following detailed description, taken in conjunction with the accompanying drawings.

DETAILED DESCRIPTION OF DRAWINGS

Figure 1:
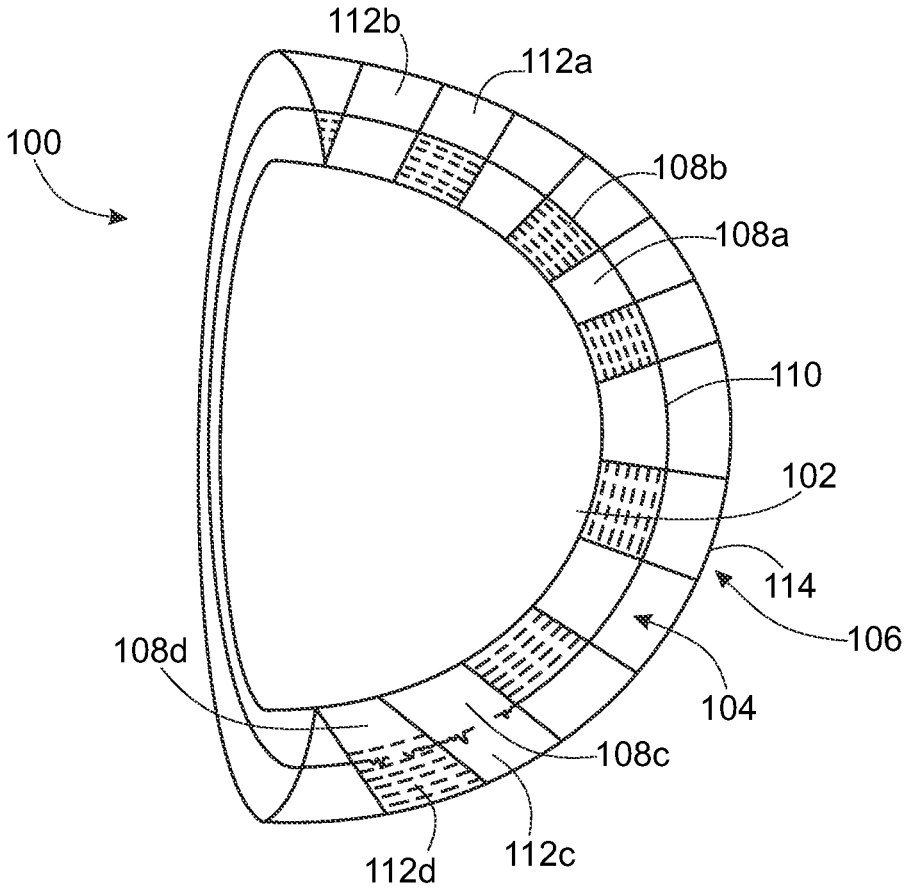
FIG. 1 is a side sectional view of an amusement ball in accordance with a preferred embodiment of the present invention.

While this technology is illustrated and described in a preferred embodiment, an amusement ball may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

Reference will now be made in detail to several embodiments of the invention which are illustrated in the accompanying drawings. Wherever feasible and convenient, the same reference numerals are used in the figures and the description to refer to the same or like parts. The drawings are in a simplified form and not to precise scale. For purposes of convenience and clarity only, directional terms, such as top, bottom, left, right, up, down, over, above, below, beneath, rear, and front may be used with respect to the accompanying drawings. These and similar directional terms should not be strictly construed to limit the scope of the invention. In addition, words such as attached, affixed, coupled, connected and similar terms with their inflectional morphemes are used interchangeably, unless the difference is noted or made otherwise clear from the context. These words and expressions do not necessarily signify direct connections, but include connections through mediate components and devices.

FIG. 1 illustrates a side sectional view of an amusement ball 100 for playing by a user. The amusement ball 100 includes an inner surface membrane 102 filled with gas, a thin puncture unit 104 positioned around the inner surface membrane 102 and an outer membrane unit 106 positioned around the thin puncturable unit 104 and the inner surface membrane 102.

The thin puncturable unit 104 includes one or more first chambers 108 and a thin puncturable membrane 110 attached to the one or more first chambers 108. At least one of the one or more first chambers 108 such as 108*a*, 108*b*, 108*c* and 108*d* is filled with liquid. As shown in FIG. 1, the first chambers 108*a* and 108*c* is blank and the first chambers 108*b* and 108*d* is filled water.

In a preferred embodiment of the present invention, the thin puncturable membrane 110 is attached to the one or more chambers 108 by glued, sonically welded or molded or other related methods. Examples of liquid include color liquid, colorless liquid, paints, ink, gel etc. However it will be readily apparent to those skilled in the art that various forms of liquid may be used without deviating from the scope of the present invention.

The outer membrane unit 106 positioned around the thin puncturable unit 102 and the inner surface membrane 104. The outer membrane unit 106 includes one or more second chambers 112 such as 112*a*, 112*b*, 112*c* and 112*d*, and a non-permeable outer membrane 114 is attached to the one or more second chambers 112. The one or more second chambers 112 are empty.

When pressure is exerted on the inner surface membrane 102 through the outer membrane unit 106 this results in the bursting of the thin puncturable membrane 110 and releasing of the liquid from the pressure exerted on specific first one or more chambers 108 to the one or more second chambers 112.

In a preferred embodiment of the present invention, as shown in FIG. 1, the pressure is exerted on the specific inner surface membrane 102 and results in bursting of the thin permeable membrane 110 at the specific location in between the one or more first chambers 108 and the one or more second chambers 112. For exemplary purposes as shown in FIG. 1 the exerted pressure results in bursting of the thin permeable membrane 110 in between the one or more first chambers 108*c* and 108*d* and the one or more second chambers 112*c* and 112*d*. The first chamber 108*c* is empty thus no liquid is passed on to the second chamber 112*c*. However, the first chamber 108*d* is filled with liquid and thus on bursting of thin permeable membrane 110 from the pressure exerted location results in the transfer of liquid from the first chamber 108*d* to the second chamber 112*d*. Thus the liquid is visible from the outer non-permeable membrane 114.

In a preferred embodiment of the present invention, a user exerts a pressure on a specific section or sections of the amusement ball 100 either by bouncing, catching or throwing on a target. However it will be readily apparent to those skilled in the art that various other means may also be used to exert pressure on the amusement ball 100 without deviating from the scope of the present invention.

Figure 2:
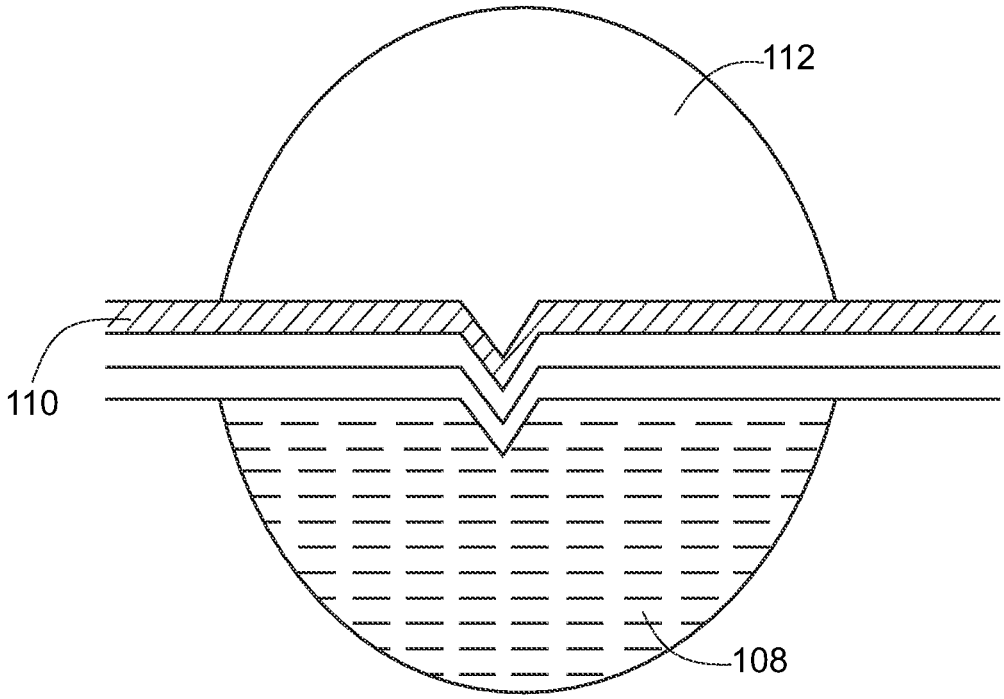
FIG. 2 is a sectional view of transferring of liquid from one or more first chambers to one or more second chambers in accordance with a preferred embodiment of the present invention.

The process of transfer of liquid from the one or more first chambers 108 to the one or more second chambers 112 is explained in detail in conjunction with FIG. 2 of the present invention. The liquid is now visible through the non-permeable outer membrane 114. The visibility of liquid on the non-permeable outer membrane 114 is explained in detail in conjunction with FIG. 4 of the present invention.

FIG. 2 illustrates a sectional view of transferring of liquid from one or more first chambers 108 to the one or more second chambers 112. On exerting the pressure the thin puncturable membrane 110 bursts to transfer the liquid from the one or more first chambers 108 to the one or more second chambers 112. In a preferred embodiment of the present invention, the thin puncturable membrane 110 is made up of hard plastic. Further, the edges of thin puncturable membrane 110 are sharper and are highly stretched to make reasonably breakable on application of the pressure.

Figure 3:
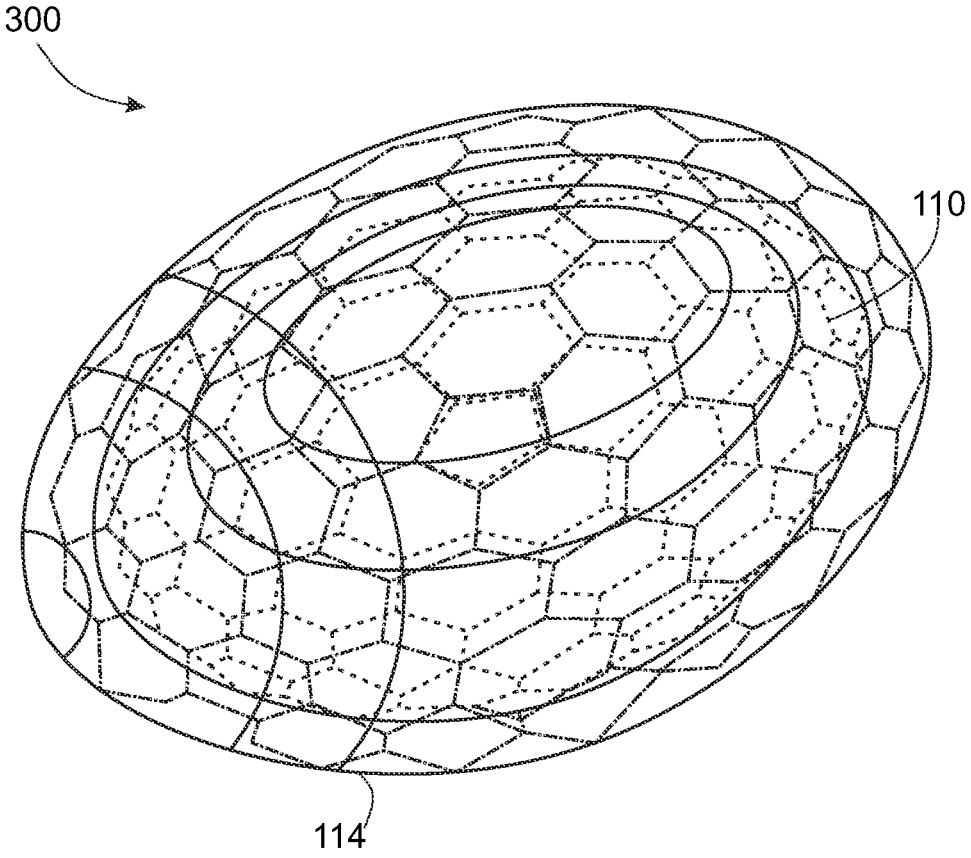
FIG. 3 is a front sectional view of an amusement ball in accordance with a preferred embodiment of the present invention.

FIG. 3 illustrates a front sectional view of the amusement ball 300 in accordance with another preferred embodiment of the present invention. In another preferred embodiment of the present invention, the shape of amusement ball 300 is a prolate spheroid. However, it will be readily apparent to those skilled in the art that various other shapes of the amusement ball 300 may be made such as spherical without deviating from the scope of the present invention. The non-permeable outer membrane is 114 is stain free thus it shows that no pressure is exerted to break the inner permeable membrane 110.

Figure 4:
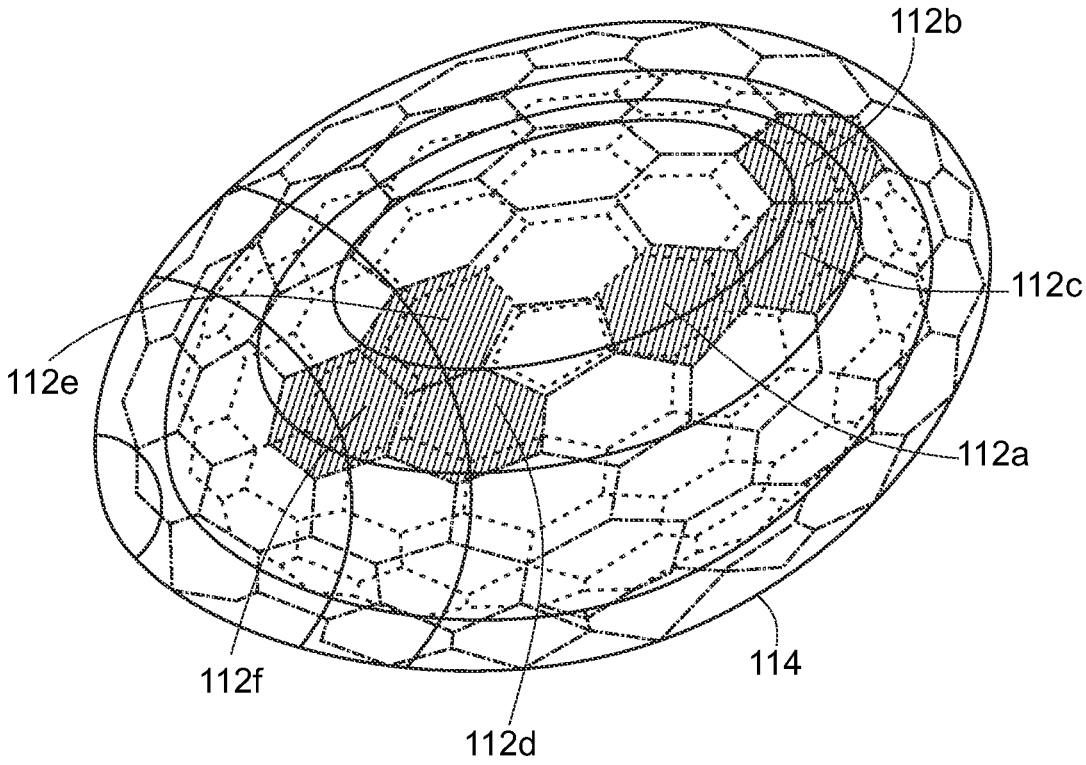
FIG. 4 is another front sectional view of the amusement ball displaying one or more liquid stains in accordance with a preferred embodiment of the present invention.

FIG. 4 illustrates another front sectional view of the amusement ball 400 showing patches of liquid on the inner surface of non-permeable outer membrane 114. In a preferred embodiment of the present invention, the non-permeable outer membrane is transparent and thus the liquid is visible. The liquid is visible on the specific one or more second chambers 112 such as 112*a*, 112*b*, 112*c*, 112*d*, 112*e* and 112*f* on rupturing of corresponding one or more first chambers 110 such as 110*a*, 110*b*, 110*c*, 110*d*, 110*e* and 110*f* (not shown in FIG. 4).

The present invention offers various advantages. The present invention offers an alternative to regular ball game associated with throwing, bouncing and catching. The present invention further changes elements of ball play, relating to changed graphics on the ball to give an exciting feature that interests children in sport play that is competitive with comparables such as computer games.

The foregoing discussion discloses and describes merely exemplary embodiments of the technology described herein. One skilled in the art will readily recognize from such discussion and from the accompanying drawings that various changes, modifications and variations can be made therein without departing from the spirit and scope of the invention.

The invention claimed is:

1. An amusement ball for a user comprising:

an inner surface membrane filled with air;

a thin puncturable unit covering said inner surface membrane, said thin puncturable unit comprising a plurality of first chambers and a thin puncturable membrane attached to said plurality of first chambers, wherein at least one of said plurality of first chambers filled with liquid; and an outer membrane unit covering said thin puncturable unit an I said inner surface membrane, said outer membrane unit comprising a plurality of second chambers and a non-permeable outer membrane attached to said plurality of second chambers;

wherein when a pressure exerted on said inner surface membrane trough said outer membrane unit results in bursting of said thin puncturable membrane and release of said liquid from at least one of said plurality of first chambers to at least one of said plurality of second chambers.

2. The amusement ball according to claim 1 wherein said outer membrane is transparent to display the color of liquid.

3. The amusement ball according to claim 1 wherein each of said plurality of first chambers contains a similar color liquid.

4. The amusement ball according to claim 1 wherein each of said plurality of first chambers contains a different color liquid.

* * * * *